US006871910B2

(12) United States Patent
Hale

(10) Patent No.: US 6,871,910 B2
(45) Date of Patent: Mar. 29, 2005

(54) ADJUSTABLE CHAIRS AND BEDS

(75) Inventor: Richard J. Hale, Swansea (GB)

(73) Assignee: Seminar Components (UK) Limited., Swansea (GB)

( * ) Notice: Subject to any disclaimer, the term of this patent is extended or adjusted under 35 U.S.C. 154(b) by 0 days.

(21) Appl. No.: 10/485,562

(22) PCT Filed: Aug. 1, 2002

(86) PCT No.: PCT/GB02/03546

§ 371 (c)(1),
(2), (4) Date: Jun. 7, 2004

(87) PCT Pub. No.: WO03/013312

PCT Pub. Date: Feb. 20, 2003

(65) Prior Publication Data

US 2004/0212236 A1 Oct. 28, 2004

(30) Foreign Application Priority Data

Aug. 4, 2001 (GB) ..... 0119132

(51) Int. Cl.[7] ..... A47C 3/20

(52) U.S. Cl. ..... 297/330; 297/325; 297/463.2; 297/DIG. 10; 248/188.1

(58) Field of Search ..... 297/272.4, 325, 297/330, 463.1, 463.2, DIG. 10; 248/188.1, 188.2, 421, 678

(56) References Cited

U.S. PATENT DOCUMENTS

| | | | | |
|---|---|---|---|---|
| 3,250,569 | A | * | 5/1966 | Gaffney ..... 297/330 |
| 3,522,925 | A | | 8/1970 | Buchtel |
| 3,698,673 | A | | 10/1972 | Olsen |
| 4,538,854 | A | | 9/1985 | Wilson |
| 4,778,216 | A | * | 10/1988 | Stupakis ..... 297/DIG. 8 |
| 5,528,782 | A | * | 6/1996 | Pfeuffer et al. ..... 297/330 |
| 6,295,767 | B1 | * | 10/2001 | Barnhill et al. ..... 52/79.1 |
| 2002/0125751 | A1 | | 9/2002 | Bullard |

FOREIGN PATENT DOCUMENTS

| | | |
|---|---|---|
| DE | 298 12 763 | 10/1998 |
| EP | 0 793 930 | 9/1997 |
| FR | 2 333472 | 7/1977 |
| GB | 2 343 371 | 5/2000 |

* cited by examiner

*Primary Examiner*—Peter R. Brown
(74) *Attorney, Agent, or Firm*—Young & Thompson

(57) ABSTRACT

An adjustable chair(1) includes a .chassis(2) onto which the chair is moveably mounted with respect thereto about a common plane normal to the major plane of the chassis, a pair of side walls (8) extending from the chassis and adapted to, in use, prevent accidental access to the space between the chassis and the chair from respective sides thereof, wherein at least one tambour(9,10) is provided between the front and/or the rear of the chair relative to said side, the or each tambour therefore providing a rigid but moveable barrier to accidental entry into the space between the chair and the chassis.

7 Claims, 9 Drawing Sheets

ADJUSTABLE CHAIRS AND BEDS

This invention relates to adjustable chairs and beds of the type which are powered by mechanisms which allow all or part of the chair or bed, as the case may be, to be moved from one position to another, such as in the case of a chair, from an upright to a horizontal configuration etc.

Hereafter the term "chair" is intended to encompass other items of powered and moveable furniture including beds, where the general configuration is adjustable in a variety of ways including height, tilt and overall geometry.

A problem with adjustable chairs, especially adjustable chairs that are powered and operable by an occupant thereof, such as an invalid, is that when the chair has been moved into e.g. a relatively high and inclined position in order to allow the occupant to stand, children and animals may thereafter become entrapped thereunder when the chair is returned to its normal and relatively low position. To help prevent this, fixed side walls are usually fitted to such chairs and in order to prevent access to the front and/or rear of the chair flexible screens such as bellows or stretched fabric have traditionally been used.

However, a disadvantage of such traditional protection lies in the fact that it is necessarily flexible and can therefore still allow entry of a child or an animal into the space between the chair and the chassis or frame onto which it is mounted, or the floor, as the case may be.

The present invention is derived from the realisation that it would be preferable to have at all times a rigid barrier to protect against the accidental entry of children or small animals into the space afforded between the chair and the floor at the front and/or back of the chair even when the chair is being moved from one position to another, such as a low position to a high position and back again.

According to the invention there is provided an adjustable chair including a chassis onto which the chair is moveably mounted with respect thereto about a common plane normal to the major plane of the chassis, a pair of side walls extending from the chassis and adapted to, in use, prevent accidental access to the space between the chassis and the chair from respective sides thereof, CHARACTERISED IN THAT at least one tambour is provided between the front and/or the rear of the chair relative to said side, the or each tambour therefore providing a rigid barrier to accidental entry into the space between the chair and the chassis.

Conveniently, where the chair is intended to be raised at the front as well as at the rear, front and rear tambours are provided, each being fixed to respective parts of the front and rear of the chair and a forward and rearward part of the chassis between the side walls.

In an alternative embodiment of the invention, only one tambour is provided at the rear of the chair, access to the chassis from the front being prevented by a rigid or semi rigid flap extending substantially between the side walls and being fixed to a lower front portion of the chassis, such as by being pivoted thereto, the flap being held in a substantially upright position during movement of the seat of the chair by being guided between a pair of guide rails so as to substantially prevent or inhibit access to the inside of the chassis from the front during such movement.

In a further alternative embodiment, the chair is provided with a tambour at the rear mounted on a spring biased roller or drum fixed for rotation on a lower portion of the chassis, the free end of the tambour being secured to a rear portion of the chair, and at the front there is another tambour fixed to a lower portion of the chassis between a pair of guide rails, the tambour being preferably spring biased also, and being fixed at its free end to a front portion of the chair. With this arrangement, it has been found that the chair may be tilted forward and downwardly to a greater extent than if the front tambour were mounted on a roller or drum, since as the chair is lowered downwards and forwards the tambour slides back between the guide rails underneath the chair substantially in the plane of the floor on which the chair rests such that in its fully retracted position the tambour covers substantially the whole of the underside of the chair.

The invention will now be described, by way of example only, with reference to the accompanying drawings in which.

Figure 1:
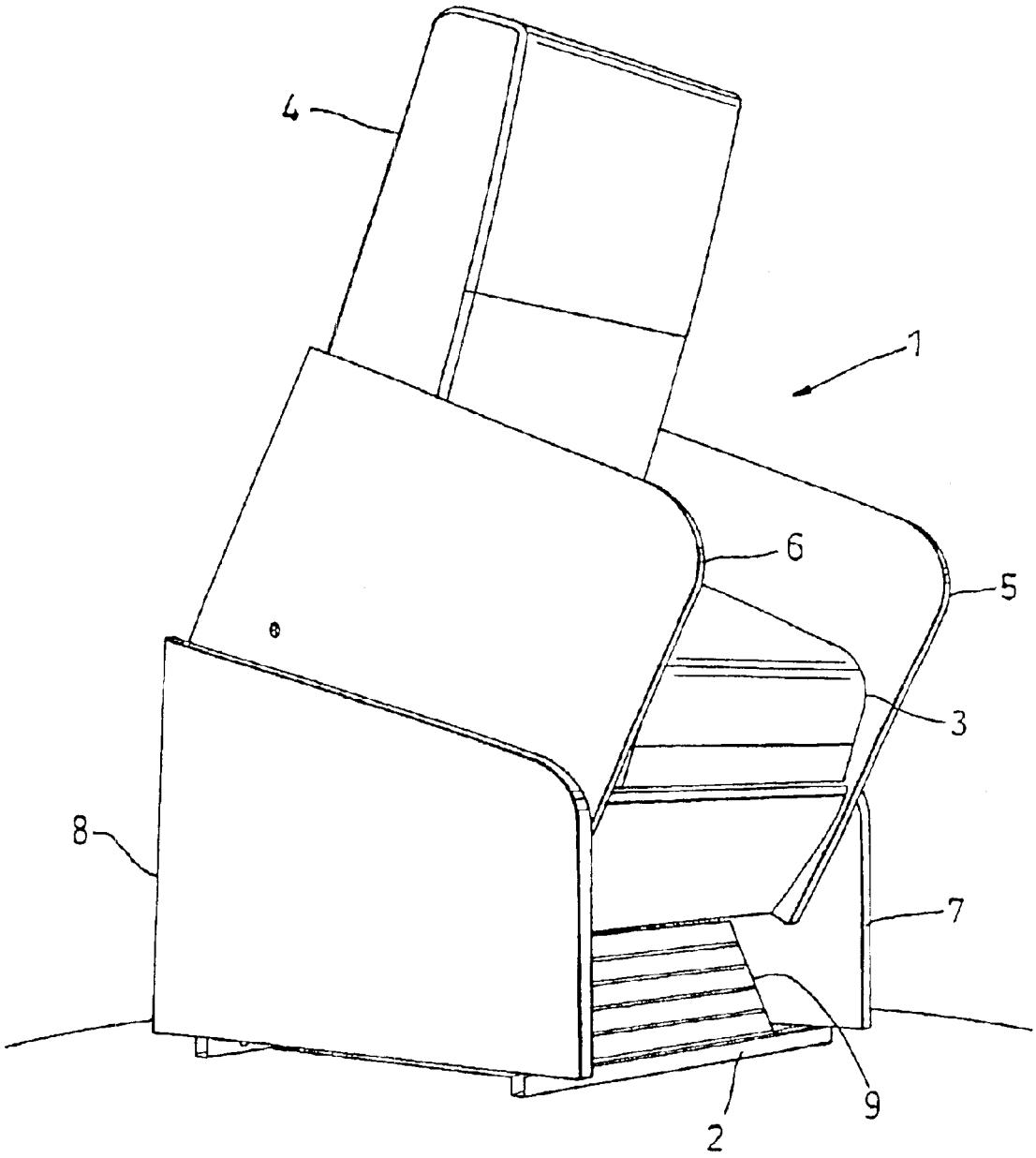
FIG. 1 is a perspective view from the front and one side of an adjustable chair according to a first embodiment of the invention.
Figure 2:
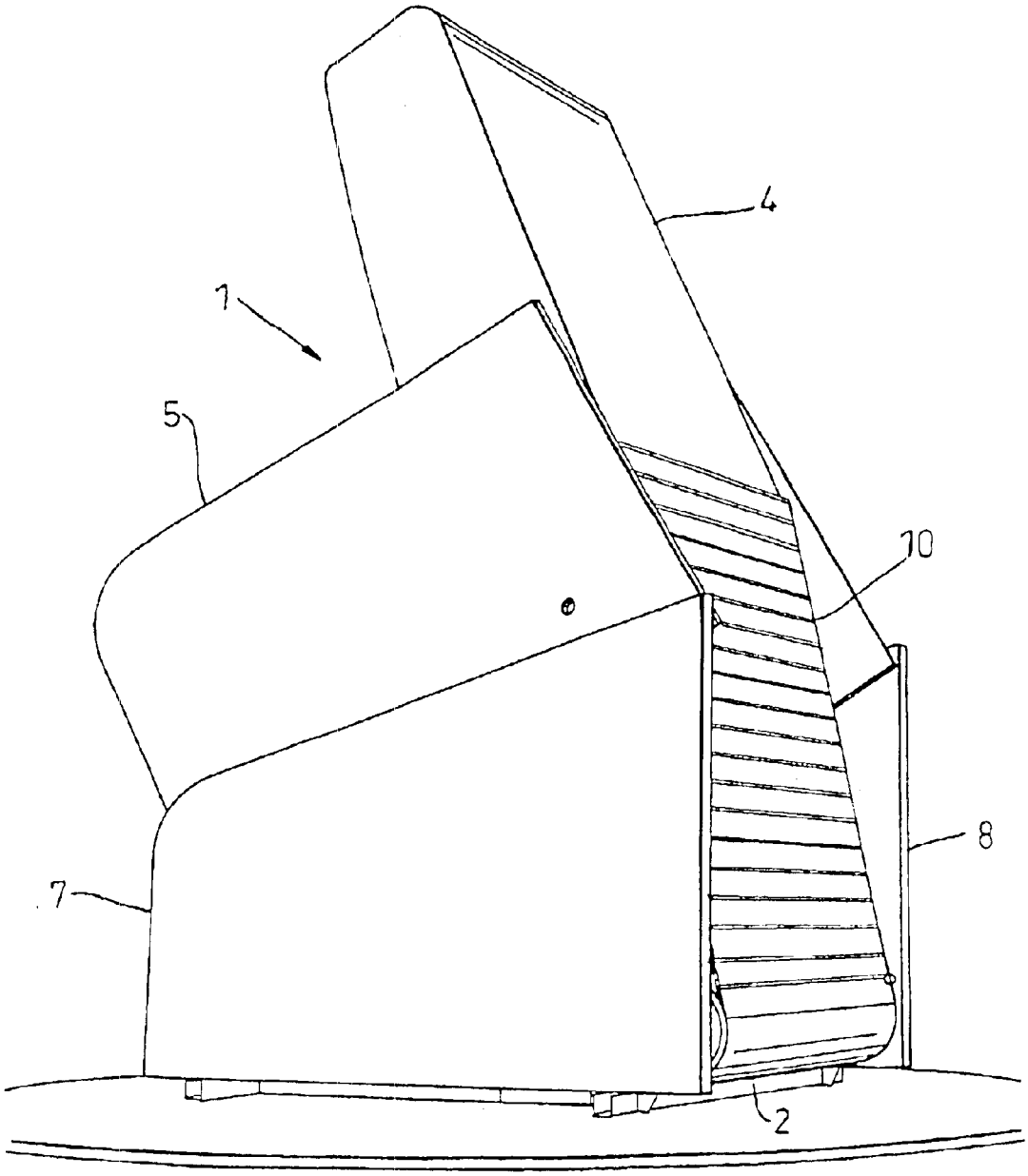
FIG. 2 is a perspective view from the rear and one side of the chair of FIG. 1.

Referring firstly to FIGS. 1 and 2 there is shown a conventional adjustable chair shown generally at 1 mounted for upward and inclined movement, in a manner to be explained, on a rectilinear steel chassis 2, both drawings depicting the chair 1 in its fully extended and inclined position corresponding to a position in which an occupant thereof may stand, if previously seated, or sit if previously standing adjacent thereto. The chair 1 includes a seat 3, backrest 4 and armrests 5,6, which armrests are slidably moveable inside a pair of correspondingly shaped side walls 7,8 fixed to chassis 2 and extending upwardly therefrom.

As can be seen from FIG. 1, a first tambour 9 prevents access to the space between the side walls 7,8 from the front of the chair 1 and as will be seen from FIG. 2 a second tambour 10 does likewise with respect to the rear of the chair 1.

Figure 3:
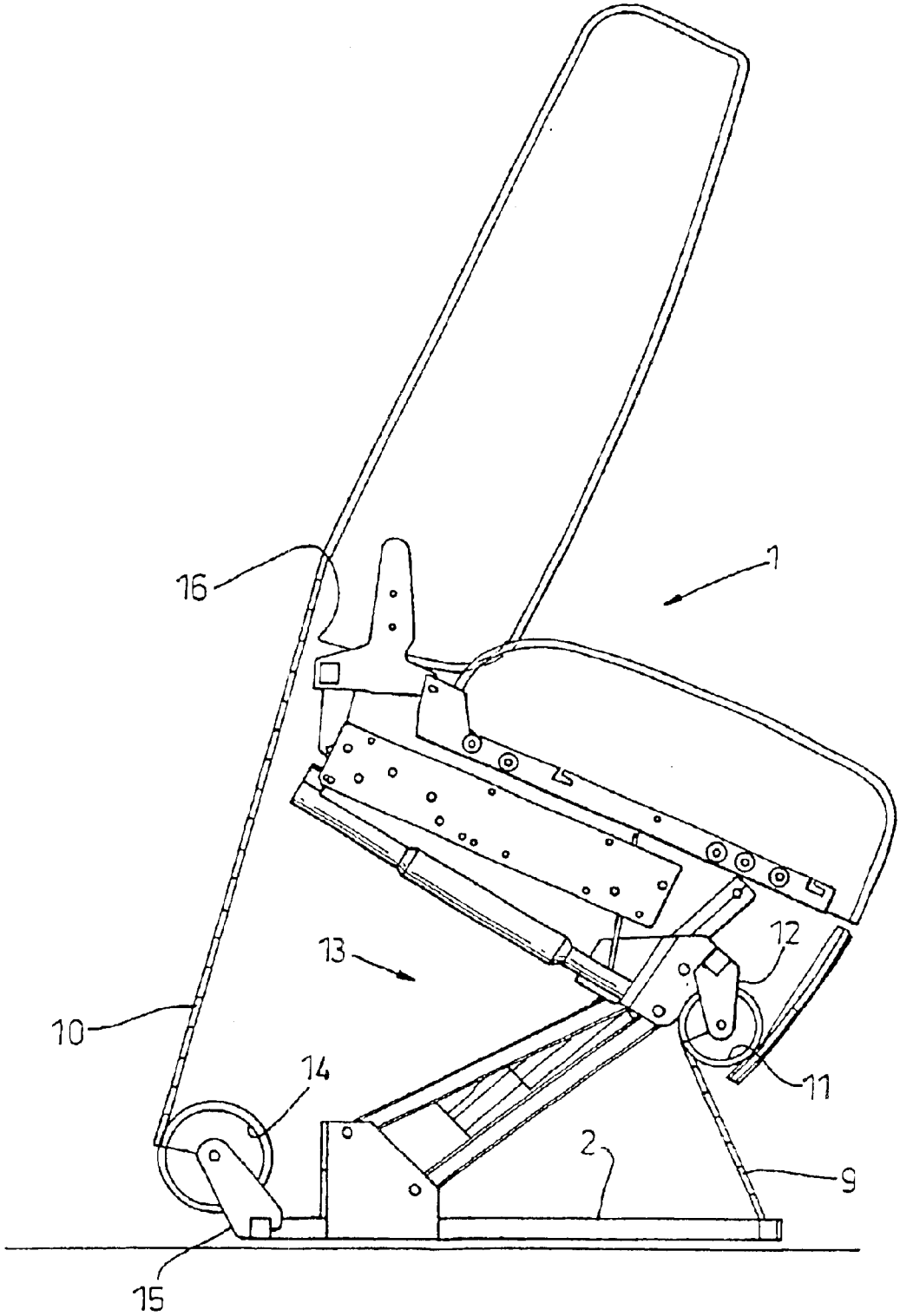
FIG. 3 is a side elevation of the chair of FIG. 1 at its highest position.
Figure 4:
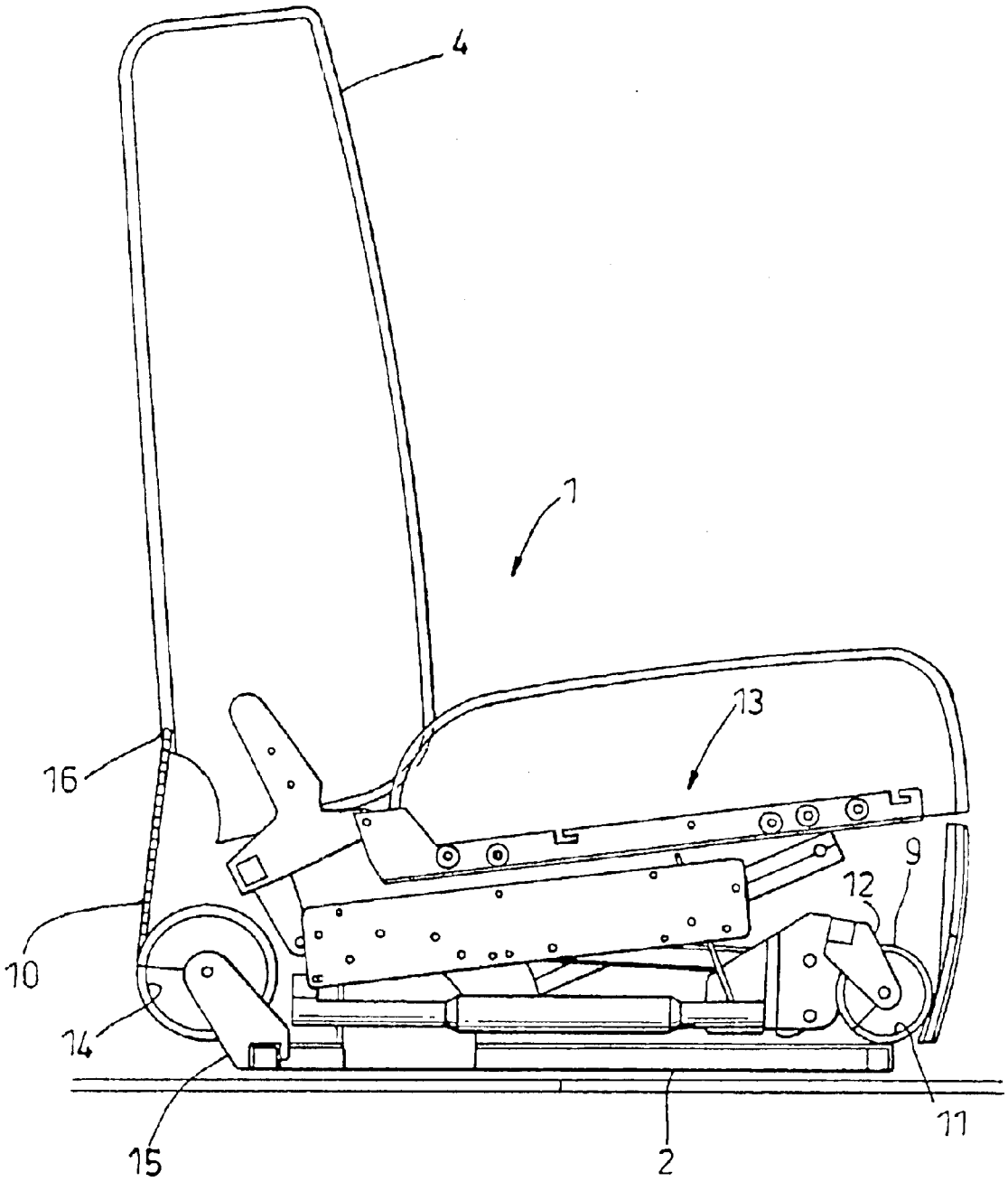
FIG. 4 is a side elevation of the chair of FIG. 1 at its lowest, extended position.

Turning now to FIGS. 3 and 4, the mechanism by which the tambours 9,10 operate is illustrated and in which it will be seen that the first tambour 9 is mounted on a cylindrical roller or drum 11 rotatably mounted between a pair of spigots 12 (only one of which is shown) connected to a forward end of the operating mechanism shown generally at 13 of the chair 1.

Similarly, the second tambour 10 is rolled around a cylindrical roller 14 rotatably mounted between a pair of spigots 15 (only one of which is shown), the otherwise free end of which is fixed to the lower rear edge 16 of the backrest 4.

The cylindrical rollers 11,14 are each spring-biased to wind the respective tambours 9,10 onto them so that, in use, there is never a gap between the respective tambours 9,10 which can be accessed from the front or rear of the chair 1, and since the side walls 7,8 prevent access from the sides it will be apparent that with the use of tambours otherwise significant safety hazard is eliminated or mitigated by the invention.

Although this embodiment of the invention shows the tambours 9,10 mounted for rotation on cylindrical rollers 11,14 on, respectively, a forward end of the chair operating mechanism 13 and at a rearward end of the chassis 2, it will be appreciated that these rollers 11,14 may be mounted the other way around so that the roller 11 is mounted on a forward end of the chassis 2 and the roller 14 may be mounted on a rearward end of the operating mechanism 13, or both could be mounted on respective forward and rearward edges of either the operating mechanism 13 or the chassis 2.

Figure 5:
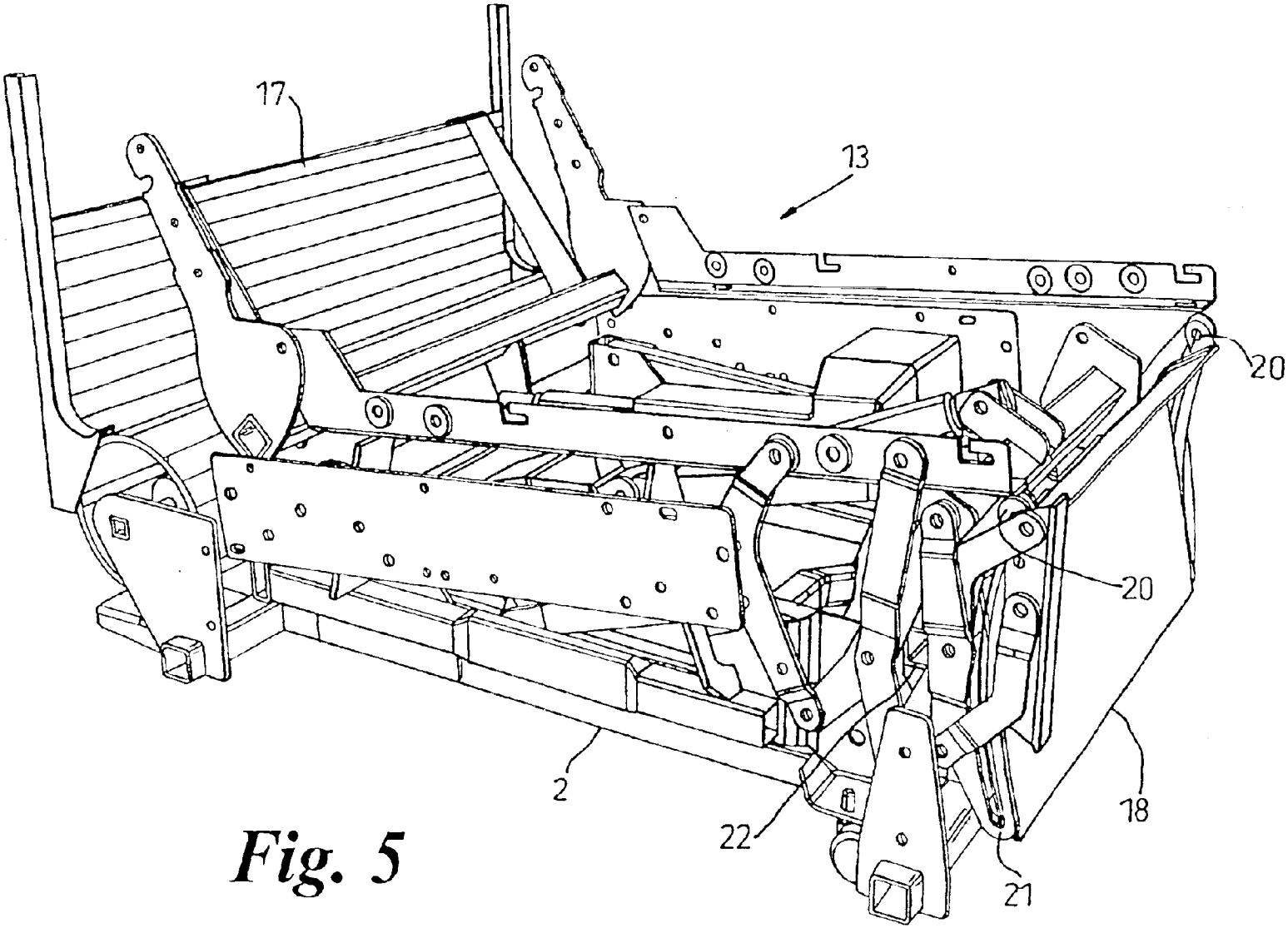
FIG. 5 is a perspective view from the front and one side of part of a second embodiment of the invention in which the chair operating mechanism is shown in its lowermost position.
Figure 6:
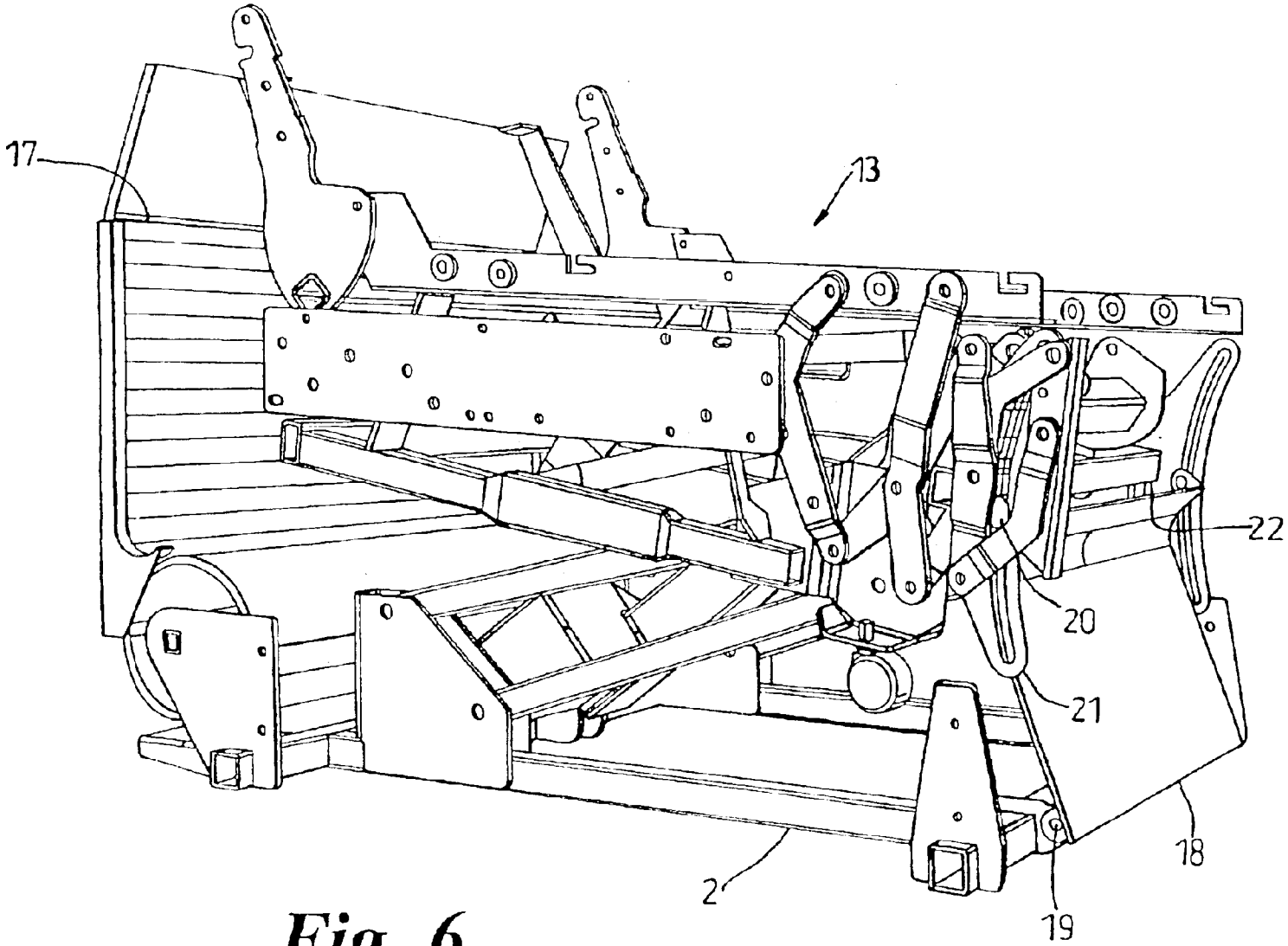
FIG. 6 is a perspective view of the chair of FIG. 5 showing the chair in an intermediate, part raised position.
Figure 7:
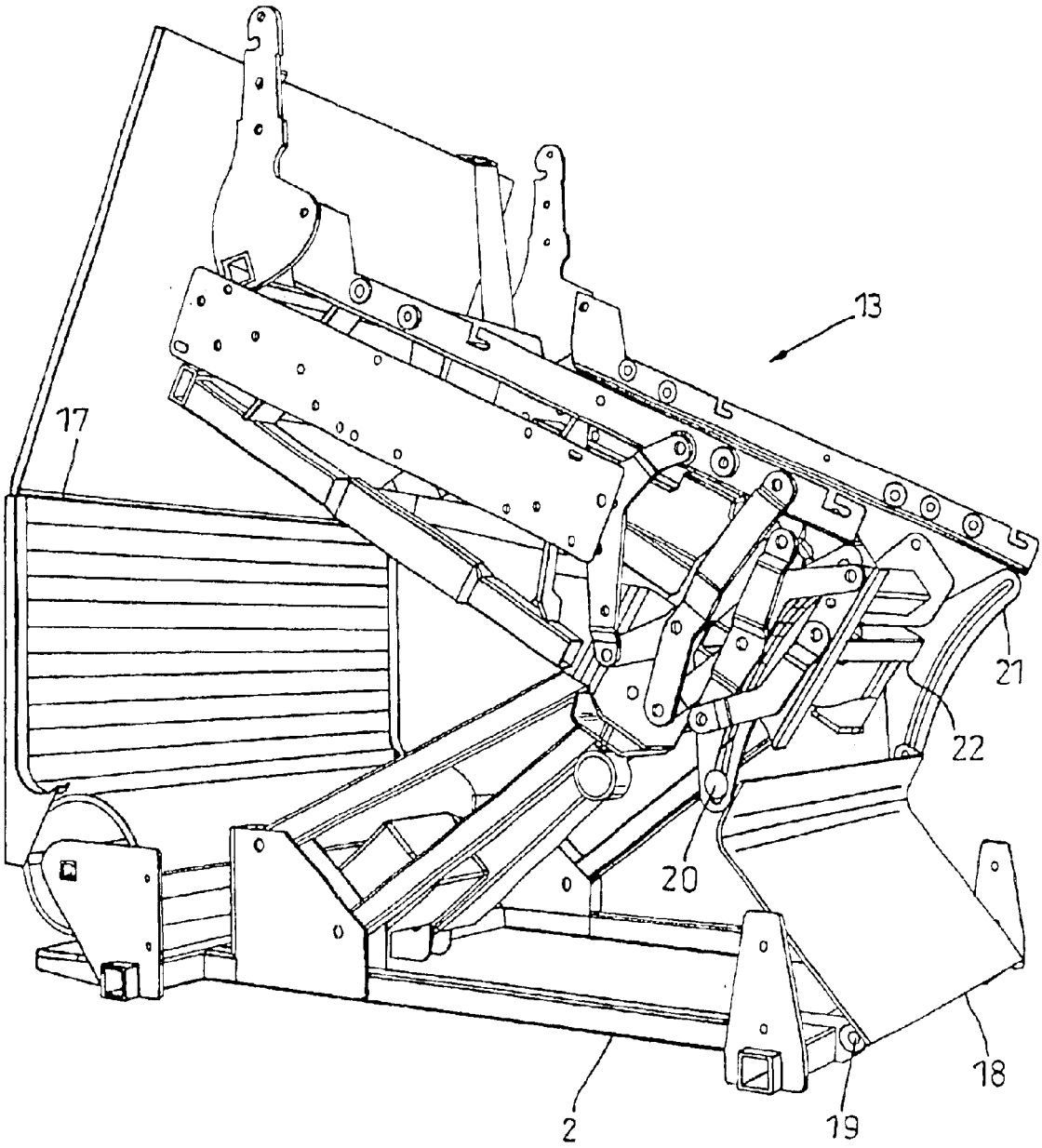
FIG. 7 is a perspective view of the chair of FIG. 5 showing the chair in its fully raised position.

An alternative embodiment of the invention is shown with reference to FIGS. 5 to 7 in which the chair operating mechanism 13 is shown, respectively, in its fully lowered position, in an intermediate position, and in its fully raised position. In this embodiment the chair only has one tambour 17 mounted at the rear in the same manner as the embodiment shown with reference to FIGS. 1 to 4 but at the front there is provided instead a rigid or semi rigid flap 18 pivotally mounted to a front region of the chassis 2 on pivot pins 19 (shown in FIGS. 6 and 7), the upper end of the flap 18 being provided with guide pins 20 at respective ends, each receivable within an arcuate guide rail or track 21 secured to a front portion 22 of the chair operating mechanism 13.

With this arrangement, when the chair operating mechanism is in its lowest position as shown in FIG. 5, the flap 18 prevents access to the interior of the chair and as is shown with reference to FIGS. 6 and 7, by virtue of the provision of the guide pins 20 and guide tracks 21 on either side thereof the flap 18 also prevents access to the interior of the chair when raised to an intermediate or to a fully raised position.

Figure 8:
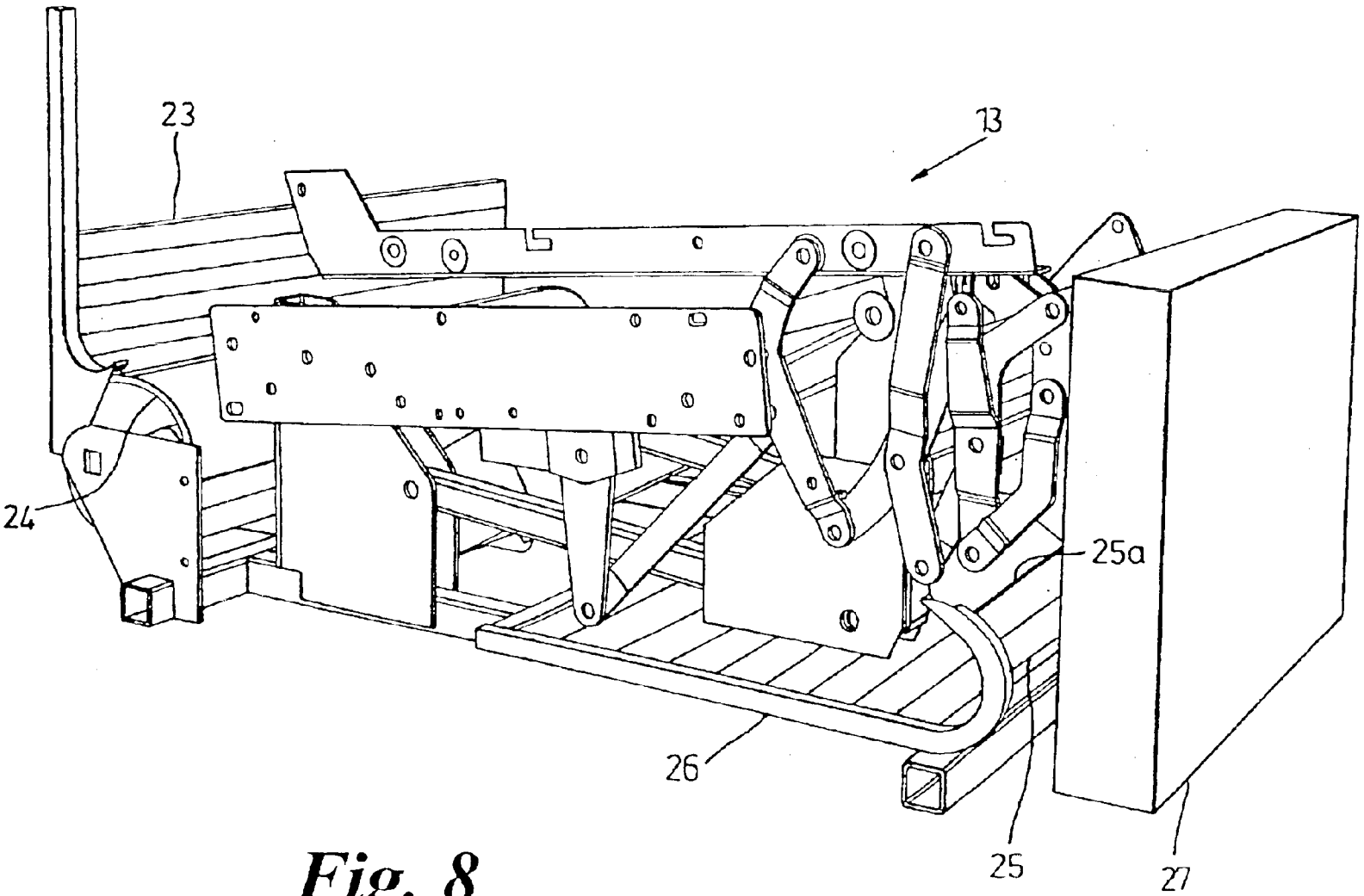
FIG. 8 is a perspective view from the front and one side of part of a chair according to a third embodiment of the invention at its lowest position.
Figure 9:
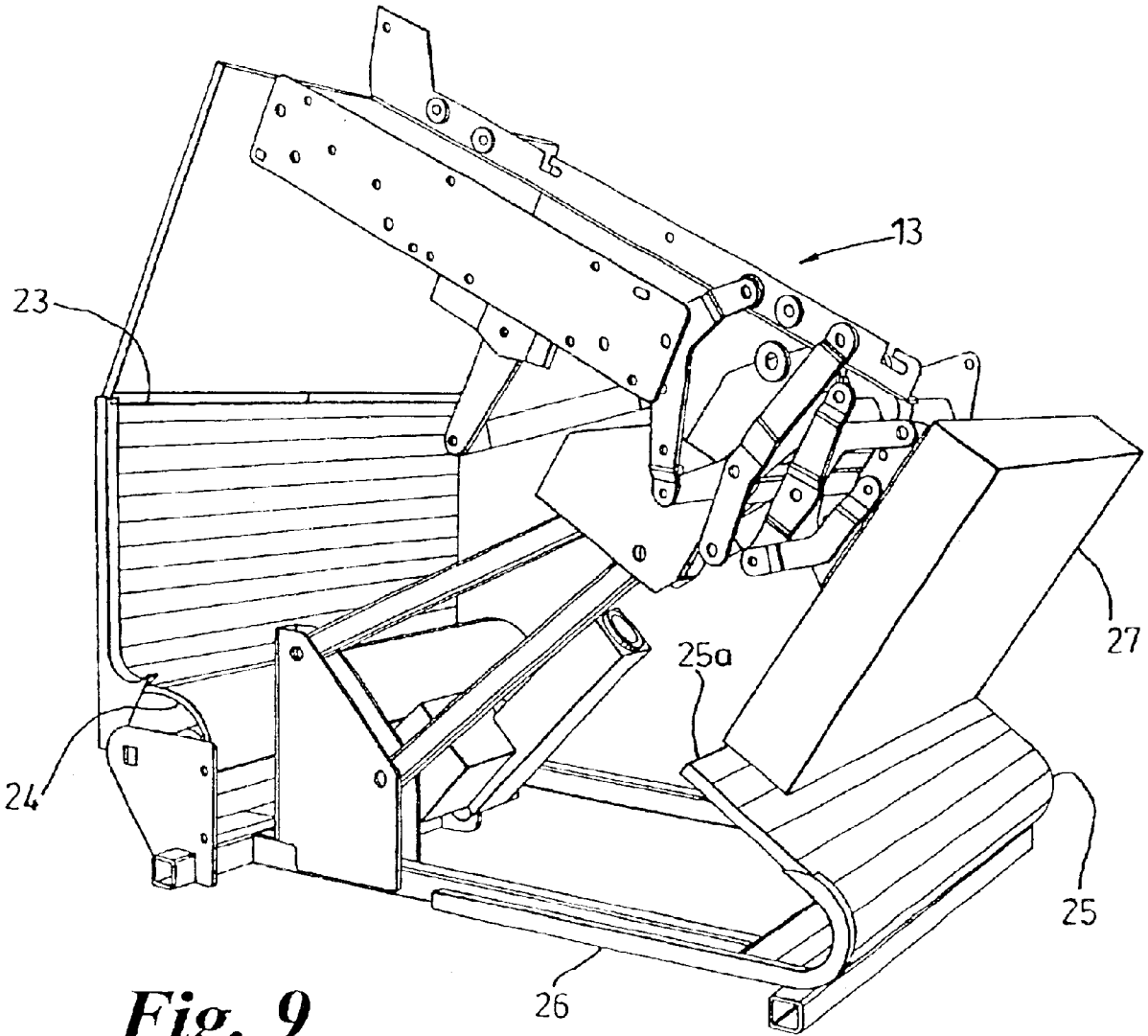
FIG. 9 is a perspective view of the chair of FIG. 8 shown in its fully raised position.

In a further alternative embodiment as shown with reference to FIGS. 8 and 9, a tambour 23 is provided on a roller 24 at the rear of the chair and a tambour 25 is provided at the front, but in this case is slidingly received within a pair of oppositely disposed guide rails 26 (only one of which is shown); the tambour 25 being spring biased to the position shown in FIG. 8 and thereby being moveable to the position shown in FIG. 9 when the chair operating mechanism 13 is in its fully raised position. A foldable foot rest 27 is also secured to a front part of the chair operating mechanism 13 which, when raised to the position shown in FIG. 9 nevertheless still provides for the tambour 25 to be partially pulled out of the guide rails 26 by being secured at its leading edge 25*a*, to a fixed part (not shown) of the chair operating mechanism 13, the tambour 25 returning to the position shown in FIG. 8 when the chair operating mechanism 13 is lowered.

The invention therefore provides, in its several embodiments, for the prevention of easy access to the inner workings of the chair through the simple yet elegant expedient of one or more tambours at the front and rear of the chair, or by through the use of one tambour in conjunction with a flap pivoted to a lower portion of the chair chassis, although it will be understood that other combinations may be adopted without departing from the spirit or scope of the invention.

What is claimed is:

1. An adjustable chair(1) including a chassis(2) onto which the chair is moveably mounted with respect thereto about a common plane normal to the major plane of the chassis, a pair of side walls(18) extending from the chassis and adapted to, in use, prevent accidental access to the space between the chassis and the chair from respective sides thereof, CHARACTERISED IN THAT at least one tambour (9,10) is provided between the front and/or the rear of the chair relative to said side, the or each tambour therefore providing a rigid barrier to accidental entry into the space between the chair and the chassis.

2. A chair according to claim 1 further characterised in that, where the chair is intended to be raised at the front as wall as at the rear; front and rear tambours are provided, each being fixed to respective parts of the front and rear of the chair and a forward and rearward part of the chassis between the side walls.

3. A chair according to claim 1 further characterised in that, only one tambour is provided at the rear of the chair, access to the chassis from the front being prevented by a rigid or semi rigid flap(18) extending substantially between the side walls and being fixed to a lower front portion of the chassis.

4. A chair according to claim 3 further characterised in that the flap is pivoted to the chassis.

5. A chair according to claim 4 further characterised in that the flap is held in a substantially upright position during movement of the seat of the chair by being guided between a pair of guide rails(21) so as to substantially prevent or inhibit access to the inside of the chassis from the front during such movement.

6. A chair according to claim 3 further characterised in that the flap is held in a substantially upright position during movement of the seat of the chair by being guided between a pair of guide rails(21) so as to substantially prevent or inhibit access to the inside of the chassis from the front during such movement.

7. A chair according to claim 1 further characterised in that it is provided with a tambour(23) at the rear mounted on a spring biased roller(24) fixed for rotation on a lower portion of the chassis, the, free end of the tambour being secured to a rear portion of the chair, and at the front there is another tambour(25) fixed to a lower portion of the chassis between a pair of guide rails(26), the tambour being preferably spring biased also, and being fixed at its free end to a front portion of the chair.

* * * * *